US007116201B2

(12) United States Patent
Fushimi

(10) Patent No.: US 7,116,201 B2
(45) Date of Patent: Oct. 3, 2006

(54) HIGH-VOLTAGE TRANSFORMER

(75) Inventor: Tadayuki Fushimi, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 11/296,262

(22) Filed: Dec. 8, 2005

(65) Prior Publication Data

US 2006/0125592 A1 Jun. 15, 2006

(30) Foreign Application Priority Data

Dec. 15, 2004 (JP) ..... 2004-363713

(51) Int. Cl.
*H01F 27/30* (2006.01)

(52) U.S. Cl. ..... 336/198

(58) Field of Classification Search ..... 336/65, 336/83, 192, 198, 200, 220–222
See application file for complete search history.

(56) References Cited

U.S. PATENT DOCUMENTS 5,847,518 A * 12/1998 Ishiwaki ..... 315/276
6,002,319 A * 12/1999 Honma ..... 336/73
6,154,113 A * 11/2000 Murai ..... 336/198
6,611,190 B1 * 8/2003 Chui et al. ..... 336/198
6,937,129 B1 * 8/2005 Hsueh et al. ..... 336/208

FOREIGN PATENT DOCUMENTS

JP 2004-179587 6/2004

* cited by examiner

*Primary Examiner*—Tuyen T Nguyen
(74) *Attorney, Agent, or Firm*—Snider & Associates; Ronald R. Snider

(57) ABSTRACT

In a first secondary-side bobbin 50A, a roll surface of a winding section $SA_2$ is located outward in radial direction with respect to a roll surface of a winding section $SA_1$ in the vicinity of a groove 55A, while a roll surface of a winding section $SA_3$ is located outward in radial direction with respect to the roll surface of the winding section $SA_2$ in the vicinity of a groove 56A. Furthermore, the two winding sections $SA_2$, $SA_3$ cross each other so that the respective roll surfaces have substantially oval-coin-shaped cross sections and the respective major axis lines on the cross sections of the respective roll surfaces cross each other when viewed from the Y-axis direction.

12 Claims, 6 Drawing Sheets

HIGH-VOLTAGE TRANSFORMER

RELATED APPLICATIONS

This application claims the priority of Japanese Patent Application No. 2004-363713 filed on Dec. 15, 2004, which is incorporated herein by reference.

BACKGROUND OF THE INVENTION

1. Field of the Invention

The present invention relates to a high-voltage transformer mounted on a circuit board of various types of electronic device, and more particularly, to a high-voltage transformer suitable for use in a DC/AC inverter circuit which causes a plurality of cold-cathode discharge lamps (CCFL) for a backlight of various types of liquid crystal display panel used for a notebook personal computer or the like to discharge and turn on.

2. Description of the Prior Art

Conventionally, as a technique for providing insulation between windings of a high-voltage secondary winding of a high-voltage transformer used for an inverter circuit, a technique of forming a plurality of partition flanges on an outer surface of a secondary-side roll to divide a winding area of the roll into a plurality of winding sections to thereby reduce a potential difference between windings in each winding section is known.

A conventional high-voltage transformer to which such a technique is applied is constructed in such a way that a top layer of a secondary winding wound around one winding section is substantially flush with a top layer of a secondary winding of the neighboring winding section on both sides of a partition flange. Furthermore, since a groove is formed in the partition flange to pass the secondary winding whose winding around one winding section has been completed to the next winding section, the top layer of the secondary winding wound around the one winding section is designed to be located extremely close to the top layer of the secondary winding of the neighboring winding section with respect to the location of the groove. In such a structure, increasing the number of windings of the secondary winding in each winding section causes a voltage difference between neighboring winding sections to increase, raising the likelihood of dielectric breakdown at the location of the groove, which results in a circumstance in which restrictions must be placed on the number of windings of the secondary winding of each winding section, hence a problem that it is difficult to reduce the size of the transformer.

As a high-voltage transformer capable of solving such a problem, the applicant of the present invention proposes a high-voltage transformer (for example, see Japanese Unexamined Patent Publication No. 2004-179587) designed in such a way that in the vicinity of a groove formed in a partition flange, a difference is made between the positions of roll surfaces of neighboring winding sections such that the roll surface of the winding section on the high-voltage side is located outward in radial direction with respect to the roll surface of the winding section on the low-voltage side adjacent to the high-voltage side across the partition flange.

According to this high-voltage transformer, it is possible to place the secondary winding of the top layer of the winding section on the low-voltage side apart from the secondary winding of the top layer of the winding section on the high-voltage side in the vicinity of the groove formed in the partition flange (particularly it is possible to prevent the secondary winding passed from the winding section on the low-voltage side from contacting the secondary winding of the top layer of the winding section on the high-voltage side), and therefore even when the number of windings of the secondary winding of each winding section is increased, dielectric breakdown hardly occurs between the neighboring winding sections. For this reason, it is possible to reduce the total number of winding sections, reduce the size of the high-voltage transformer and at the same time prevent dielectric breakdown from occurring between neighboring winding sections.

In the field of manufacturing electronic devices for which miniaturization processes are being carried forward in short cycles, there is a demand for a further reduction in size of a high-voltage transformer mounted on a circuit board in recent years. Such a demand for downsizing can be roughly divided into two categories; one intended to mainly reduce the mounting area of the high-voltage transformer on a circuit board and the other intended to mainly realize a low-profile high-voltage transformer (reduce the length in direction perpendicular to the surface of the circuit board). Recently, there are an increasing number of cases where the overall volume of the high-voltage transformer is required to be reduced while balancing between a length to width ratio of the mounting area and a low-profile rate.

The high-voltage transformer in Japanese Unexamined Patent Publication No. 2004-179587 above has a tendency that when the direction of the roll is assumed to be lateral direction, the length in this lateral direction is greater than lengths in longitudinal direction (width) or height direction. Therefore, methods for reducing the total number of winding sections or reducing the total length of a roll to reduce the overall size while balancing between length, width and height or the like have been explored. However, to reduce the total number of winding sections while securing a predetermined output voltage, the number of windings of the secondary winding of each winding section cannot help but be increased and this increase in the number of windings in each winding section directly results in an increased diameter of the secondary winding in each winding section. Moreover, in order to provide a sufficient function to prevent dielectric breakdown between neighboring winding sections, it is necessary to increase an amount of displacement in surface positions of respective rolls of the neighboring winding sections by the amount of increase in the diameter of winding of secondary windings of the respective winding sections. Furthermore, when a core (magnetic core) is inserted into the roll, it is also necessary to increase the diameter of the roll itself as the amount of displacement in surface positions of respective rolls to secure the space for the insertion of this core.

The invention disclosed in Japanese Unexamined Patent Publication No. 2004-179587 above assumes that a direction parallel to the surface of the circuit board or a direction perpendicular to the surface of the circuit board is mainly the direction in which a difference is made between the positions of the roll surfaces of the neighboring winding sections. For this reason, the influence of increasing the diameter of the roll itself of each winding section or the winding diameter of the secondary winding to be wound directly results in an increase in the size in the direction in which the difference is made between the positions of roll surfaces. That is, when the displacement direction is parallel to the surface of the circuit board, the mounting area of the high-voltage transformer increases significantly, whereas when the displacement direction is perpendicular to the surface of the circuit board, the high-voltage transformer has a significantly high profile. Therefore, there is a problem that it is difficult to reduce the size of the transformer with balanced length, width and height while preventing dielectric breakdown between neighboring winding sections.

SUMMARY OF THE INVENTION

The present invention has been implemented in view of the above described circumstances and it is an object of the present invention to provide a high-voltage transformer capable of realizing downsizing with balanced length, width and height while preventing dielectric breakdown between neighboring winding sections.

In order to attain such an object, the high-voltage transformer according to the present invention is a high-voltage transformer including: an insulating secondary-side bobbin made up of a roll, around which a secondary winding electromagnetically coupled with a primary winding is wound, divided into a plurality of winding sections lined up in a direction in which a central axis of the roll extends by a plurality of partition flanges arranged separated from one another in the direction, wherein grooves are formed in the partition flanges for passing the secondary winding from a low-voltage side winding section adjacent to the partition flange to a high-voltage side winding section, wherein the roll surface of the high-voltage side winding section is constructed so as to be located outward in radial direction with respect to the roll surface of the low-voltage side winding section in the vicinity of the groove, and wherein at least one set of two winding sections out of the plurality of winding sections provided for the secondary-side bobbin are constructed in such a way that each roll surface within a surface crossing the central axis at right angles has a flat cross section and the respective axis lines corresponding to a major axis in the cross section of the each roll surface cross each other when viewed from a direction in which the central axis extends.

The roll surface of the winding section on the high-voltage side is preferably located outward in radial direction by an amount equivalent to the thickness of the secondary winding wound in the winding section on the low-voltage side with respect to the roll surface of the winding section on the low-voltage side.

Here, the term "flat shape" means an eccentric shape, for example, elliptic, so-called oval-coin shape, oval shape, flat rectangular shape such as rectangle and rhombus (including those with rounded corners), semi-circle shape or polygon such as hexagon (including those with rounded corners) formed into a flat shape or the like.

In addition to the above described structure, the two winding sections can be constructed in such a way that the respective axis lines cross each other at substantially right angles when viewed from the direction in which the central axis extends and cross the surface of a circuit board in which the high-voltage transformer is mounted at substantially 45 degrees. Furthermore, of the plurality of winding sections provided for the secondary-side bobbin, a winding section located on a lowest-voltage side of the roll is preferably constructed so as to have the roll surface of a substantially circular cross section within a surface perpendicular to the central axis.

Furthermore, the high-voltage transformer can also be constructed in such a way that a first secondary-side bobbin and a second secondary-side bobbin are provided in such a way that tips of the respective rolls face each other via an insulating flange-shaped barrier, a core insertion hole extending in direction in which the central axis of the roll extends is formed substantially coaxially inside the roll of the first secondary-side bobbin and the roll of the second secondary-side bobbin and the flange-shaped barrier is provided with a spacer insertion hole into which an insulating spacer to secure a predetermined magnetic gap between a core inserted into the core insertion hole of the first secondary-side bobbin and a core inserted into the core insertion hole of the second secondary-side bobbin.

Furthermore, the high-voltage transformer can also be constructed in such a way that a secondary-side terminal support in which a secondary-side terminal is implanted, is formed integral with the first secondary-side bobbin, the second secondary-side bobbin and the flange-shaped barrier.

Furthermore, the high-voltage transformer can also be constructed in such a way that the first primary-side bobbin and the second primary-side bobbin each have a roll around which the primary winding is wound and are provided in such a way that ends of the respective rolls face each other via an insulating flange-shaped barrier, a core insertion hole extending in a direction in which the central axis of the roll extends is formed inside the roll of the first primary-side bobbin and the roll of the second primary-side bobbin substantially coaxially respectively and the flange-shaped barrier is provided with a spacer insertion hole into which an insulating spacer to secure a predetermined magnetic gap between a core inserted into the core insertion hole of the first primary-side bobbin and a core inserted into the core insertion hole of the second primary-side bobbin.

Furthermore, the high-voltage transformer can also be constructed in such a way that a primary-side terminal support in which the primary-side terminal is implanted is formed integral with the first primary-side bobbin, the second primary-side bobbin and the flange-shaped barrier.

Furthermore, the high-voltage transformer can also further include two E-shaped cores.

DESCRIPTION OF THE PREFERRED EMBODIMENTS

Figure 1:
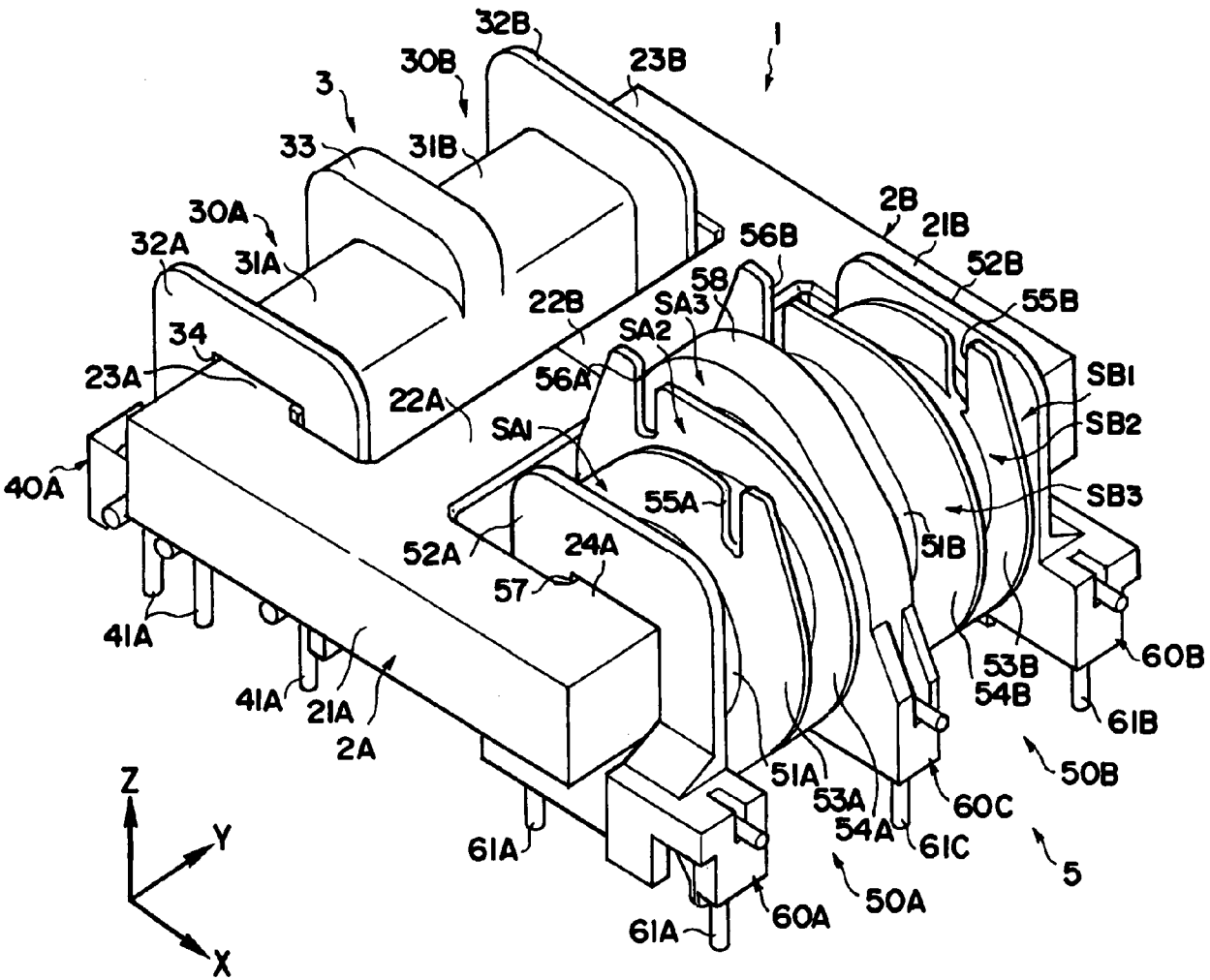
FIG. 1 is a perspective view (windings are not shown) of a high-voltage transformer according to an embodiment of the present invention viewed from above its top surface.
Figure 2:
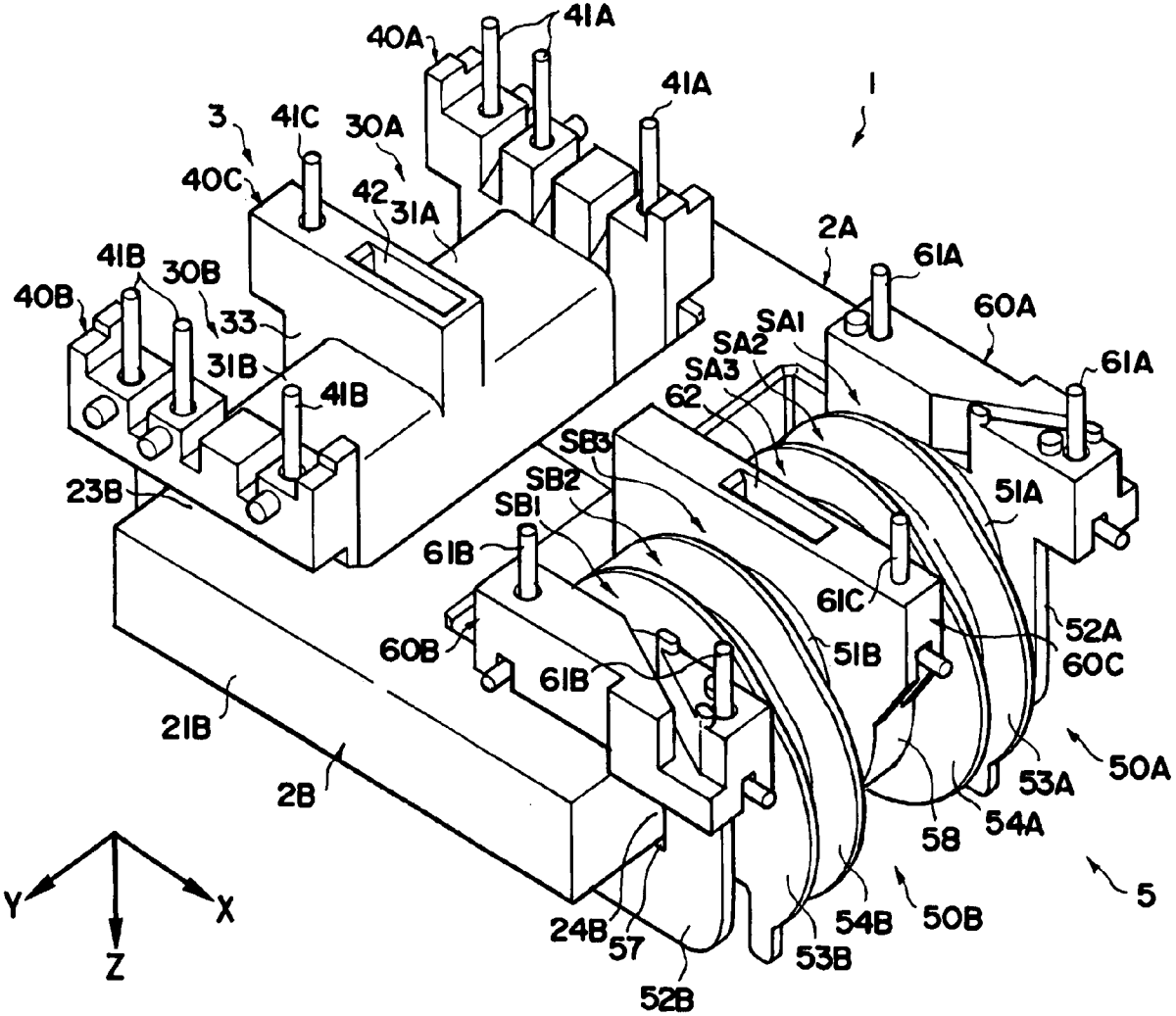
FIG. 2 is a perspective view (windings are not shown) of the high-voltage transformer shown in FIG. 1 viewed from below its bottom surface.
Figure 3:
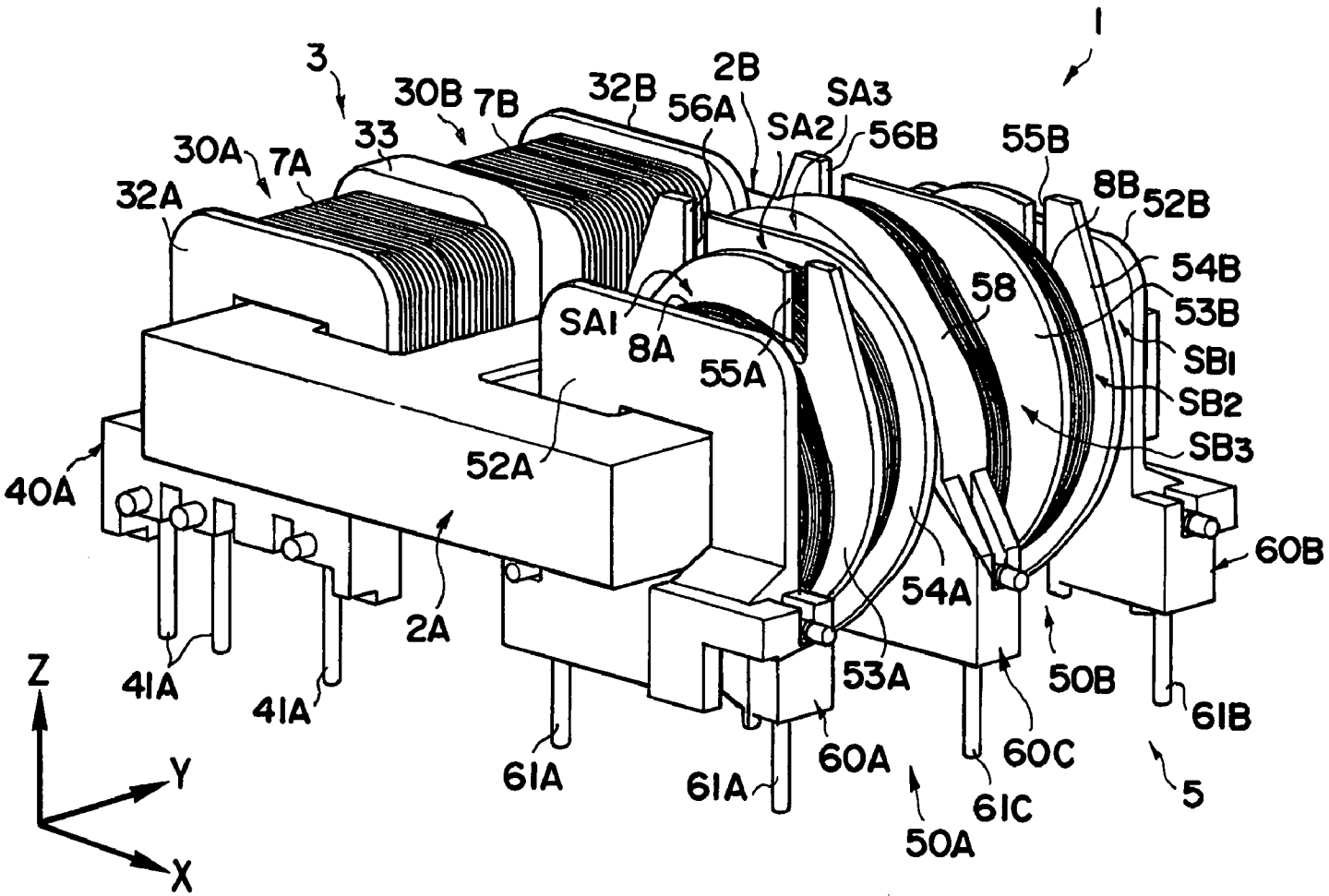
FIG. 3 is a perspective view of the high-voltage transformer shown in FIG. 1 furnished with windings.

With reference now to the attached drawings, an embodiment of a high-voltage transformer according to the present invention will be explained in detail below. FIG. 1 is a perspective view showing the overall structure of the high-voltage transformer according to an embodiment of the present invention viewed from above its top surface, FIG. 2 is a perspective view of this high-voltage transformer viewed from below its bottom surface and FIG. 3 is a perspective view of this high-voltage transformer furnished with windings. First, the overall structure of the high-voltage transformer will be schematically explained based on these FIGS. 1 to 3. To clarify the directional correspondence among the drawings, coordinate axes are shown in the respective drawings.

A high-voltage transformer 1 shown in FIG. 1 is used inside a DC/AC inverter circuit. It is an inverter transformer that can cause two CCFLs (cold-cathode discharge lamps) to discharge and turn on simultaneously and constructed of two E-shaped cores 2A, 2B made of ferrite which is a soft magnetic material (or permalloy, sendust, iron carbonyl or dust core obtained by compressed-molding powder of these substances can also be used), a primary-side bobbin/terminal support 3 and a secondary-side bobbin/terminal support 5.

As shown in FIG. 3, the primary-side bobbin/terminal support 3 is constructed of a first primary-side bobbin 30A wound with a first primary winding 7A a second primary-side bobbin 30B wound with a second primary winding 7B and as shown in FIG. 2, a first primary-side terminal support 40A in which three primary-side terminals 41A are implanted, a second primary-side terminal support 40B in which three primary-side terminals 41B are likewise implanted and a third primary-side terminal support 40C in which one primary-side terminal 41C is implanted. A beginning tip of the first primary winding 7A is tied to any one of the three primary-side terminals 41A and an end tip thereof is tied to the primary-side terminal 41C. Furthermore, a beginning tip of the second primary winding 7B is tied to any one of the three primary-side terminals 41B and an end tip thereof is tied to the primary-side terminal 41C.

The first and second primary-side bobbins 30A, 30B are made up of cylindrical rolls 31A, 31B around which the first and second primary windings 7A, 7B are wound respectively and flange plates 32A, 32B provided at respective one ends of these rolls 31A, 31B, and the rolls 31A, 31B are placed with the other ends facing each other via a flange-shaped barrier 33. Note that the first and second primary-side bobbins 30A, 30B, first, second and third primary-side terminal supports 40A, 40B, 40C and flange-shaped barrier 33 are formed as one piece made of an insulating material (generally plastic material).

On the other hand, as shown in FIG. 3, the secondary-side bobbin/terminal support 5 is constructed of a first secondary-side bobbin 50A around which a first secondary winding 8A is wound and a second secondary-side bobbin 50B around which a second secondary winding 8B is wound and, as shown in FIG. 2, a first secondary-side terminal support 60A in which two secondary-side terminals 61A are implanted and a second secondary-side terminal support 60B in which two secondary-side terminals 61B are likewise implanted and a third secondary-side terminal support 60C in which one secondary-side terminal 61C is implanted. A beginning tip of the first secondary winding 8A is tied to any one of the two secondary-side terminals 61A and an end tip thereof is tied to the secondary-side terminal 61C. Furthermore, a beginning tip of the second secondary winding 8B is tied to any one of the two secondary-side terminals 61B an end tip thereof is tied to the secondary-side terminal 61C.

As shown in FIG. 1, the first and second secondary-side bobbins 50A, 50B are constructed of cylindrical rolls 51A, 51B around which first and second secondary windings 8A, 8B are wound (see FIG. 3) respectively, flange plates 52A, 52B provided at respective one ends of the rolls 51A, 51B and two partition flanges 53A, 54A, and two partition flanges 53B, 54B placed apart from each other in direction in which the central axis of the rolls 51A, 51B extends (Y-axis direction in the figure) with the other ends of the rolls 51A, 51B facing each other via a flange-shaped barrier 58. Note that the first and second secondary-side bobbins 50A, 50B, first, second and third secondary-side terminal supports 60A, 60B, 60C and flange-shaped barrier 58 are made of an insulating material and formed as one piece.

The roll 51A is divided by the flange plate 52A and two partition flanges 53A, 54A and flange-shaped barrier 58 into three winding sections $SA_1$, $SA_2$, $SA_3$ lined up in the Y-axis direction in the figure and the roll 51B is likewise divided by the flange plate 52B, two partition flanges 53B, 54B and flange-shaped barrier 58 into three winding sections $SB_1$, $SB_2$, $SB_3$ lined up in the Y-axis direction in the figure.

Furthermore, a groove 55A is formed in the partition flange 53A for passing the first secondary winding 8A (see FIG. 3) wound in the winding section $SA_1$ to the neighboring winding section $SA_2$ and a groove 56A is formed in the partition flange 54A for passing the first secondary winding 8A wound in the winding section $SA_2$ to the neighboring winding section $SA_3$. Likewise, a groove 55B is formed in the partition flange 53B for passing the second secondary winding 8B (see FIG. 3) wound in the winding section $SB_1$ to the neighboring winding section $SB_2$ and a groove 56B is formed in the partition flange 54B for passing the second secondary winding 8B wound in the winding section $SB_2$ to the neighboring winding section $SB_3$. The structures of the first and second secondary-side bobbins 50A, 50B constitute the essential parts of the present invention in this embodiment and this will be explained in detail later.

Furthermore, as shown in FIG. 1, the above described E-shaped core 2A is constructed of a base 21A extending in the X-axis direction in the figure, a middle leg 22A extending in the Y-axis direction in the figure perpendicular to the base 21A in the center of this base 21A and outer legs 23A, 24A extending in the Y-axis direction in the figure perpendicular to the base 21A at both ends of the base 21A. Likewise, as shown in FIG. 2, the above described E-shaped core 2B is constructed of a base 21B extending in the X-axis direction in the figure, a middle leg 22B extending in the Y-axis direction in the figure perpendicular to the base 21B in the center of this base 21B and outer legs 23B, 24B extending in the Y-axis direction in the figure perpendicular to the base 21B at both ends of the base 21B. FIG. 1 and FIG. 2 show only parts of the outer legs 23A, 24A, 23B, 24B of the E-shaped cores 2A, 2B, but they have substantially the same length as that of the middle legs 22A, 22B.

As shown in FIG. 1, a core insertion hole 34 is formed in the primary-side bobbin/terminal support 3 penetrating the roll 31A of the first primary-side bobbin 30A and roll 31B of the second primary-side bobbin 30B in the Y-axis direction in the figure and a core insertion hole 57 is formed in the secondary-side bobbin/terminal support 5 penetrating the roll 51A of the first secondary-side bobbin 50A and roll 51B of the second secondary-side bobbin 50B in the Y-axis direction in the figure. The two E-shaped cores 2A, 2B are disposed in such a way that the respective middle legs 22A, 22B between the primary-side bobbin/terminal support 3 and secondary-side bobbin/terminal support 5, and the respective outer legs 23A, 23B in the core insertion hole 34 on the primary side and the respective outer legs 24A, 24B in the core insertion hole 57 on the secondary-side are placed with their respective ends facing each other with a predetermined magnetic gap (magnetic gap may also be omitted) therebetween so as to form a predetermined magnetic path in this way.

Furthermore, as shown in FIG. 2, a spacer insertion hole 42 is formed in the third primary-side terminal support 40C of the primary-side bobbin/terminal support 3 with its opening provided on the bottom face (facing up in FIG. 2) and reaching the core insertion hole 34 (see FIG. 1). Likewise, a spacer insertion hole 62 is formed in the third secondary-side terminal support 60C of the secondary-side bobbin/terminal support 5 with its opening provided on the bottom face and reaching the core insertion hole 57. These spacer insertion holes 42, 62 will be explained in further detail later.

Figure 4B:
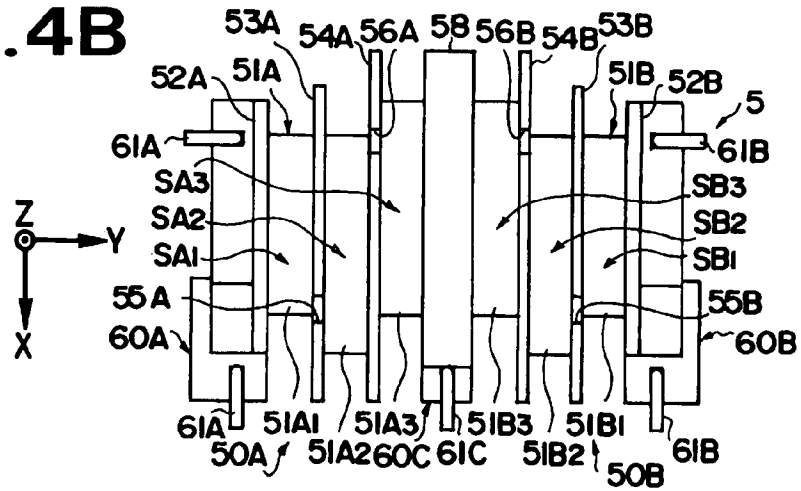
FIG. 4B is a plan view of the first secondary-side bobbin and FIG. 4C is a left-side sectional view of the first secondary-side bobbin.
Figure 4A:
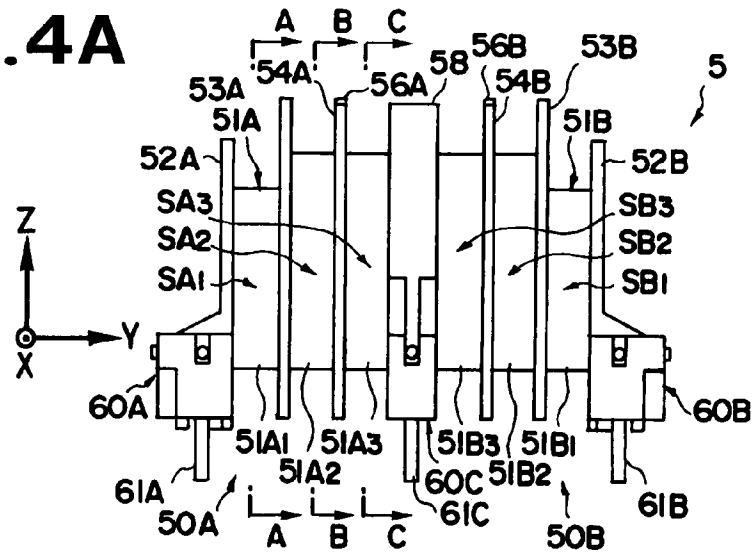
FIG. 4A is a front view of a first secondary-side bobbin.
Figure 4C:
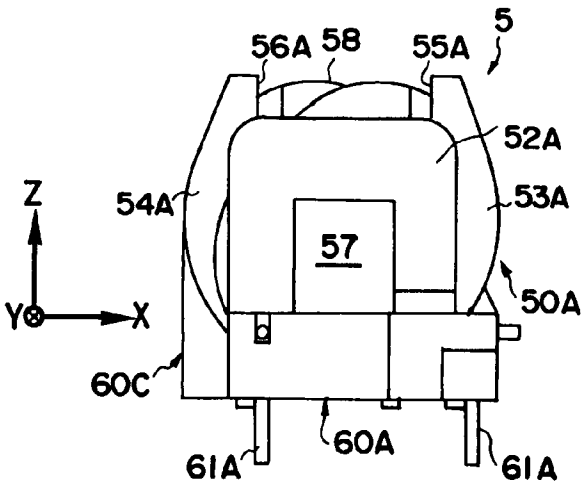
Figure 5:
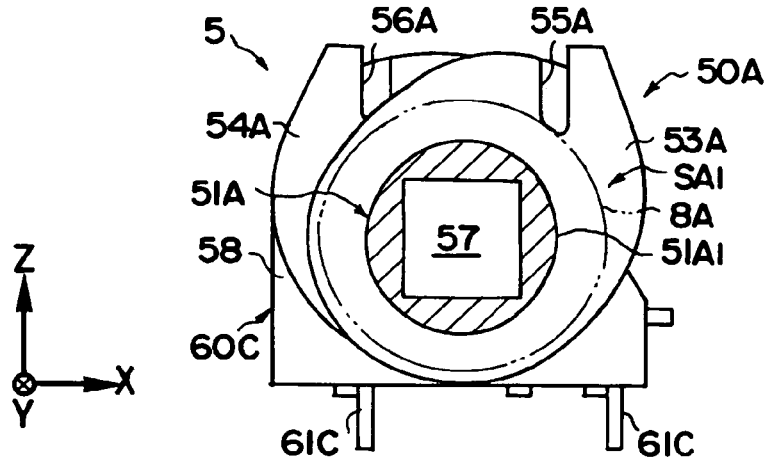
FIG. 5 is a cross-sectional view along a line A—A in FIG. 4A.
Figure 6:
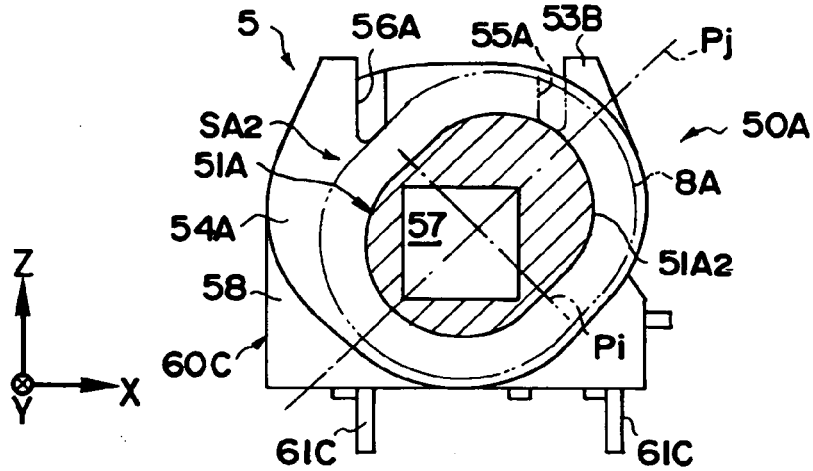
FIG. 6 is a cross-sectional view along a line B—B in FIG. 4A.
Figure 7:
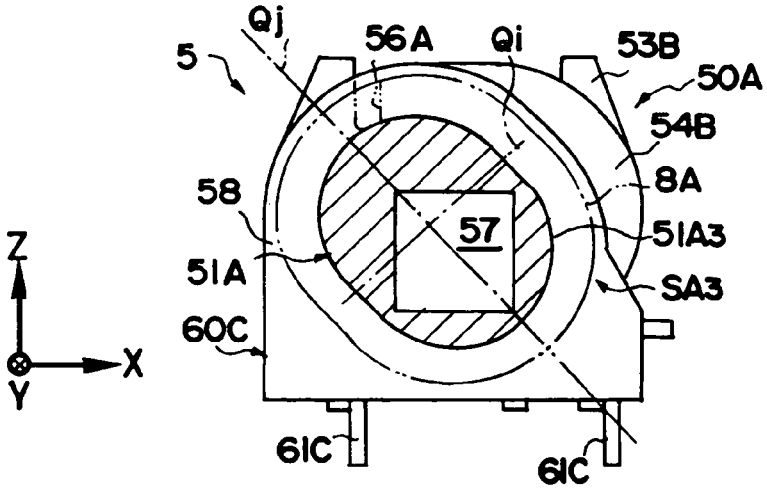
FIG. 7 is a cross-sectional view along a line C—C in FIG. 4A.

Next, the structure and operation of the secondary-side bobbin/terminal support 5 will be explained more specifically. FIG. 4 is a projection view showing the structure of the secondary-side bobbin/terminal support 5, FIG. 4A is a front view, FIG. 4B is a plan view and FIG. 4C is a left-side sectional view. Furthermore, FIG. 5 to FIG. 7 are cross-sectional views showing the structure of the above described first secondary-side bobbin 50A, FIG. 5 is a cross-sectional view along a line A—A in FIG. 4A, FIG. 6 is a cross-sectional view along a line B—B and FIG. 7 is a cross-sectional view along a line C—C. Note that the orientations of the coordinate axes shown in FIG. 4 to FIG. 7 are the same as those of the coordinate axes shown in FIG. 1 to FIG. 3.

As shown in FIG. 5, the first winding section $SA_1$ located outermost and on the low-voltage side of the first secondary-side bobbin 50A has a roll surface 51$A_1$ of a circular cross section. In this winding section $SA_1$, the first secondary winding 8A whose beginning tip is tied to the first secondary-side terminal support 60A (see FIG. 4) is wound until a partial area of its top layer (shown by a virtual line in FIG. 5) reaches the tip of the groove 55A of the partition flange 53A. The first secondary winding 8A which has been wound is passed to the neighboring second winding section $SA_2$ (see FIG. 6) through the groove 55A.

As shown in FIG. 6, a roll surface 51$A_2$ of this second winding section $SA_2$ is structured so that its area close to the above described groove 55A (shown by a virtual line in the figure) is substantially flush with the tip of this groove 55A. Namely, the two neighboring winding sections $SA_1$, $SA_2$ on both sides of the above described partition flange 53A are constructed in the vicinity of the groove 55A in such a way that the roll surface 51$A_2$ of the winding section $SA_2$ on the high-voltage side is located outward in radial direction by an amount equivalent to the thickness of the first secondary winding 8A wound in the winding section $SA_1$ with respect to the roll surface 51$A_1$ of the winding section $SA_1$ on the low-voltage side. This allows the top layer of the first secondary winding 8A wound in the first winding section SA, to be kept separated from the top layer of the first secondary winding 8A wound in the second winding section $SA_2$, thus preventing dielectric breakdown from occurring between the two winding sections $SA_1$, $SA_2$ at the position at which the groove 55A is formed.

Furthermore, the second winding section $SA_2$ is formed in such a way that its roll surface 51$A_2$ has a cross section similar to that of an oval gold coin formerly used in Japan (combination of a circle and straight lines). The axis line corresponding to a major axis of an ellipse (hereinafter referred to as "major axis line Pj") and axis line corresponding to a minor axis (hereinafter referred to as "minor axis line Pi") crossing each other at right angles on the cross section of this roll surface 51$A_2$ are arranged so as to cross the surface of a circuit board (not shown) at an angle of 45 degrees. The first secondary winding 8A in the winding section $SA_2$ is wound until a partial area (area located on the above described minor axis line Pi in FIG. 6) of its top layer (shown by virtual line in FIG. 6) reaches the tip of the groove 56A of the partition flange 54A. The first secondary winding 8A which has been wound is passed to the neighboring third winding section $SA_3$ (see FIG. 7) through the groove 56A.

As shown in FIG. 7, a roll surface 51$A_3$ of this third winding section $SA_3$ is constructed in such a way that an area (area close to a major axis line Qj which will be described later) close to the above described groove 56A (shown by a virtual line in FIG. 7) is substantially flush with the tip of this groove 56A. That is, the two neighboring winding sections $SA_2$, $SA_3$ on both sides of the above described partition flange 54A are constructed in the vicinity of the groove 56A in such a way that the roll surface 51$A_3$ of the winding section $SA_3$ on the high-voltage side is located outward in radial direction by an amount equivalent to the thickness of the first secondary winding 8A wound in the winding section $SA_2$ with respect to the roll surface 51$A_2$ of the winding section $SA_2$ on the low-voltage side. This allows the top layer of the first secondary winding 8A wound in the second winding section $SA_2$ to be kept separated from the top layer of the first secondary winding 8A wound in the third winding section $SA_3$, thus preventing dielectric breakdown from occurring between the two winding sections $SA_2$, $SA_3$ at the position at which the groove 56A is formed.

Furthermore, the third winding section $SA_3$ is formed in such a way that its roll surface 51$A_3$ has a cross section similar to that of an oval gold coin formerly used in Japan as in the case of the roll surface 51$A_2$ of the second winding section $SA_2$. The fact that the major axis line Qj and minor axis line Qi crossing each other at right angles on the cross section of this roll surface 51$A_3$ are arranged so as to cross the surface of a circuit board (not shown) at an angle of 45 degrees is also the same as the above described roll surface 51$A_2$. However, the roll surface 51$A_3$ is constructed in such a way that its major axis line Qj crosses the above described major axis line Pj at substantially right angles viewed from the direction in which the central axis of the roll 51A extends (direction perpendicular to the surface of this sheet).

The end tip of the first secondary winding 8A wound in the above described winding section $SA_3$ is tied to the secondary-side terminal 61C and the winding is terminated at this point. Furthermore, the second secondary-side bobbin SOB shown in FIG. 4 corresponds to the above described first secondary-side bobbin 50A arranged plane symmetric with respect to the flange-shaped barrier 58.

As described above, one feature of this embodiment is that the cross section of the roll surface 51$A_2$ of the second winding section $SA_2$ provided for the first secondary-side bobbin 50A (also the same for the second secondary-side bobbin 50B) and the cross section of the roll surface 51$A_3$ of the third winding section $SA_3$ are flat like an oval coin and the major axis line Pj on the cross section of the roll surface 51$A_2$ and major axis line Qj on the cross section of the roll surface 51$A_3$ are designed to cross each other at substantially right angles viewed from the direction in which the central axis of the roll 51A extends and cross the surface of the circuit board (not shown) at substantially 45 degrees.

This produces the following effects. Namely, the first secondary-side bobbin 50A according to this embodiment provides the first secondary winding 8A having substantially the same amount as that provided by substantially six winding sections of one secondary-side bobbin of a conventional high-voltage connector, divided into three winding sections $SA_1$, $SA_2$, $SA_3$. Since the total number of the winding sections becomes substantially half, the total length of the roll 51A is reduced drastically compared to the conventional one.

On the other hand, the amount of the first secondary winding 8A wound in the respective winding sections $SA_1$, $SA_2$, $SA_3$ is increased compared to the conventional one, and therefore the diameter of the roll 51A of the respective winding sections $SA_1$, $SA_2$, $SA_3$ and the winding diameter of the first secondary winding 8A to be wound increase. However, this embodiment constructs the roll surface 51$A_2$ of the second winding section $SA_2$ and the roll surface 51$A_3$ of the third winding section $SA_3$ as shown above and can thereby prevent the influence of such an increase in the diameter from leading to a drastic increase of the size in a specific direction within the surface of the sheet in FIG. 5 to FIG. 7 (for example, when the two winding sections $SA_2$, $SA_3$ are disposed so that the major axis line Pj shown in FIG. 6 and the major axis line Qj shown in FIG. 7 become mutually parallel, the size in the X-axis direction or Z-axis direction increases compared to that in this embodiment to prevent dielectric breakdown irrespective of the direction in which the positions of the two winding sections $SA_2$, $SA_3$ are shifted within the surface of the sheet). Therefore, it is possible to construct the entire system in a more compact structure while balancing sizes in lateral (X-axis direction), longitudinal (Y-axis direction), height (Z-axis direction) directions (X-axis direction to Z-axis direction ratio in this embodiment is substantially 1:1).

In this embodiment, the first winding section $SA_1$ has a circular cross section and has a smaller volume than the other two winding sections $SA_2$, $SA_3$. Adopting the circular cross section facilitates the winding work of the first secondary winding 8A and reducing the volume has a merit of reducing leakage of magnetic flux, but it is also possible to adopt a flat cross section for the first winding section $SA_1$. In this case, the cross section of the first winding section SA, is preferably substantially the same as the cross section of the third winding section $SA_3$ (including the orientation of the major axis line).

Furthermore, this embodiment is constructed so that the major axis line Pj and major axis line Qj cross each other at substantially right angles, but the angle of crossing is not limited to 90 degrees and it is possible to set it to various values according to the demand for compactness within a desired angle range (for example, 15 to 90 degrees, 30 to 90 degrees, 45 to 90 degrees, 60 to 90 degrees, and the like).

Figure 8:
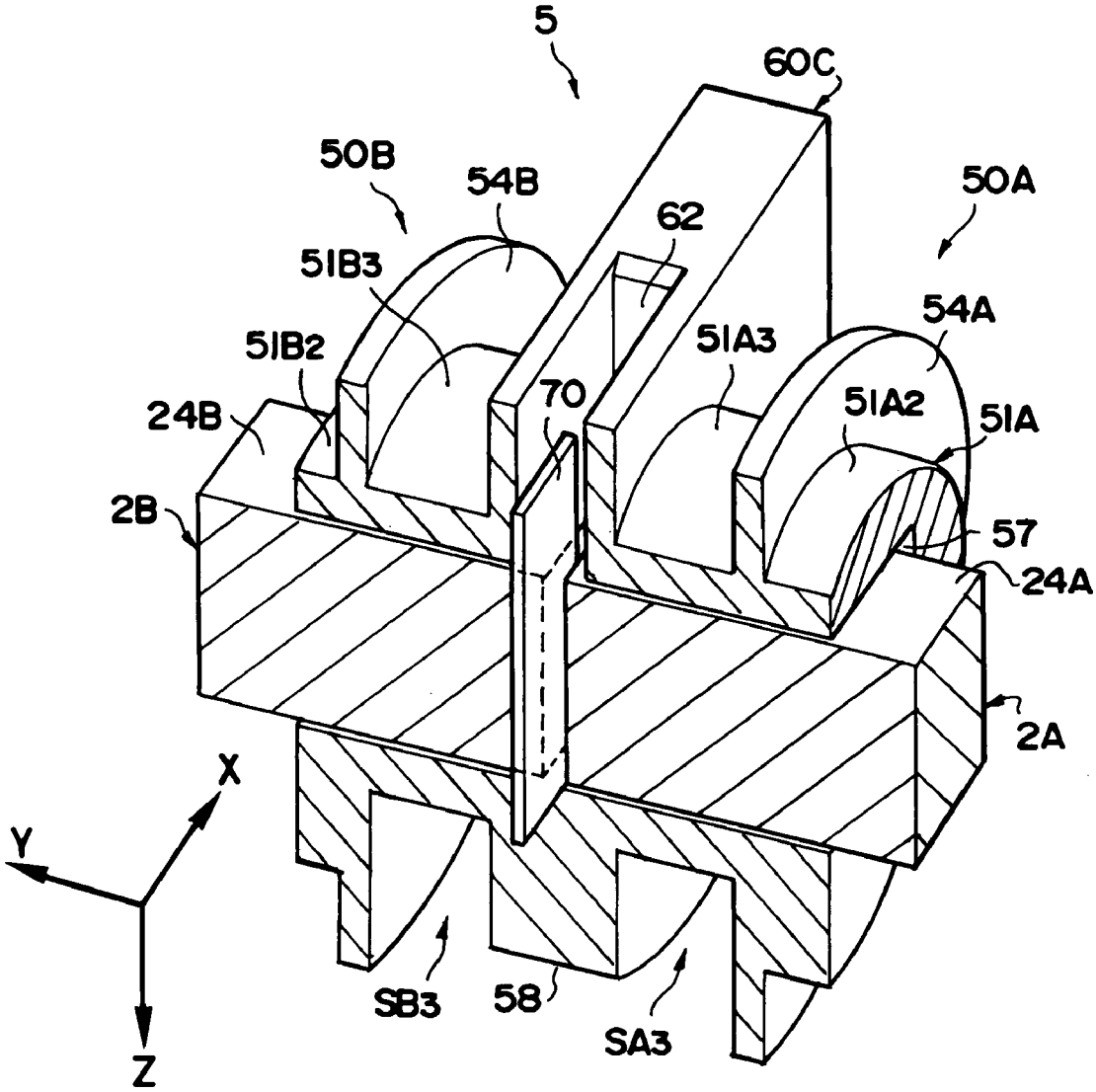
FIG. 8 is a cross-sectional perspective view showing the structure of a spacer insertion hole.

Next, the structure and operation of the spacer insertion hole 62 briefly described above will be explained in more detail with reference to FIG. 8. FIG. 8 is a cross-sectional perspective view showing the structure of the spacer insertion hole 62. Note that the spacer insertion hole 42 formed in the primary-side bobbin/terminal support 3 has substantially the same structure as that of the spacer insertion hole 62 as will be explained below, and therefore detailed explanations thereof will be omitted.

As shown in FIG. 8, the spacer insertion hole 62 is formed so as to reach the core insertion hole 57 from the bottom surface (facing up in FIG. 8) of the third secondary-side terminal support 60C of the secondary-side bobbin/terminal support 5. An insulating spacer 70 is inserted into this spacer insertion hole 62 from above in the figure to secure a predetermined magnetic gap between the outer legs 24A, 24B of the two E-shaped cores 2A, 2B.

That is, in this embodiment, with the spacer 70 inserted in the spacer insertion hole 62, the outer leg 24A of the E-shaped core 2A is inserted into the core insertion hole 57 from right in the figure and the outer leg 24B of the E-shaped core 2B is inserted into the core insertion hole 57 from left in the figure. The two E-shaped cores 2A, 2B are held so that the tips of the respective outer legs 24A, 24B contact the spacer 70 and then fixed to the secondary-side bobbin/terminal support 5 using an adhesive injected into the magnetic gap formed between the tips of the outer legs 24A, 24B.

This embodiment assumes such a structure, but if no spacer insertion hole 62 is provided, the assembly steps will be as follows, for example.

Namely, the spacer 70 is provisionally fixed to one of the facing surfaces of the outer legs 24A, 24B of the two E-shaped cores 2A, 2B using an adhesive. The adhesive is applied not only to the surface to be provisionally fixed of the spacer 70 but also to the opposite surface. Next, the outer legs 24A, 24B are inserted into the core insertion hole 57 of the secondary-side bobbin/terminal support 5 respectively. The adhesive applied to the opposite surface adheres to the other leg, it is left as is for a predetermined time to dry and in this way the two E-shaped cores 2A, 2B are fixed.

Using such steps, the core legs to which the spacer 70 is provisionally fixed with a large amount of adhesive need to be sent into the insertion hole of the bobbin, and therefore there is a problem that it is difficult to work and the adhesive may be applied to unnecessary parts.

This embodiment provides the spacer insertion hole 62 to allow the spacer 70 to be inserted and fixed using an adhesive in the above described posterior steps, and therefore it is possible to secure a predetermined magnetic gap between the two E-shaped cores 2A, 2B and improve the efficiency in the work of fixing and holding the E-shaped cores 2A, 2B in the core insertion hole 57.

An embodiment of the high-voltage transformer according to the present invention has been explained in detail, but the high-voltage transformer according to the present invention is not limited to the above described embodiment and can be modified in other various ways.

For example, in the above described embodiment, the first and second secondary-side bobbins 50A, 50B are divided into the three winding sections $SA_1$ to $SA_3$, $SB_1$ to $SB_3$, respectively, but it is also possible to divide the secondary-side bobbin into two winding sections or four or more winding sections.

Furthermore, the high-voltage transformer according to the present invention is applicable not only to an inverter transformer but also to various other transformers.

As described above, the high-voltage transformer of the present invention is constructed so that in the vicinity of the groove for passing the secondary winding from the winding section on the low-voltage side to the winding section on the high-voltage side neighboring on both sides of the partition flange, the roll surface of the high-voltage side winding section is located outward in radial direction with respect to the roll surface of the low-voltage side winding section.

This allows the secondary winding of the top layer of the low-voltage side winding section and the secondary winding of the top layer of the high-voltage side winding section to be kept separated from each other, and therefore even when the number of windings of the secondary winding in each winding section is increased, it is possible to prevent dielectric breakdown from occurring between neighboring winding sections.

Furthermore, at least one set of a plurality of winding sections provided for the secondary-side bobbin is constructed so as to have each roll surface of a flat cross section and so that the respective axis lines corresponding to the major axis cross each other when viewed from the direction in which the central axis of the roll extends in the cross sections of the respective roll surfaces.

In this way, even when the diameter of the roll of each winding section or the winding diameter of the secondary winding is increased to shorten the overall length of the roll, it is possible to prevent the influence thereof from leading to a significant increase of the size in a specific direction as in the conventional case and thereby make the overall high-voltage transformer more compact while balancing between length, width and height.

What is claimed is:

1. A high-voltage transformer comprising: an insulating secondary-side bobbin made up of a roll, around which a secondary winding electromagnetically coupled with a primary winding is wound, divided into a plurality of winding sections lined up in a direction in which a central axis of the roll extends by a plurality of partition flanges arranged separated from one another in said direction, wherein grooves are formed in said partition flanges for passing said secondary winding from a low-voltage side winding section adjacent to said partition flange to a high-voltage side winding section, wherein the roll surface of said high-voltage side winding section is constructed so as to be located outward in radial direction with respect to the roll surface of said low-voltage side winding section in the vicinity of said groove, and wherein at least one set of two winding sections out of said plurality of winding sections provided for said secondary-side bobbin are constructed in such a way that each roll surface within a surface crossing said central axis at right angles has a flat cross section and the respective axis lines corresponding to a major axis in the cross section of said each roll surface cross each other when viewed from a direction in which said central axis extends.

2. The high-voltage transformer according to claim 1, wherein said two winding sections are constructed in such a way that said respective axis lines cross each other at substantially right angles when viewed from the direction in which said central axis extends and cross the surface of a circuit board in which said high-voltage transformer is mounted at substantially 45 degrees.

3. The high-voltage transformer according to claim 1, wherein of said plurality of winding sections provided for said secondary-side bobbin, the winding section located on the lowest-voltage side of said roll is constructed so as to have said roll surface of a substantially circular cross section within a surface perpendicular to said central axis.

4. The high-voltage transformer according to claim 2, wherein of said plurality of winding sections provided for said secondary-side bobbin, a winding section located on a lowest-voltage side of said roll is constructed so as to have said roll surface of a substantially circular cross section within a surface perpendicular to said central axis.

5. The high-voltage transformer according to claim 1, wherein a first secondary-side bobbin and a second secondary-side bobbin are provided in such a way that tips of said respective rolls face each other via an insulating flange-shaped barrier, a core insertion hole extending in direction in which said central axis extends is formed substantially coaxially inside the roll of said first secondary-side bobbin and the roll of said second secondary-side bobbin, and said flange-shaped barrier is provided with a spacer insertion hole into which an insulating spacer is inserted between a core inserted into said core insertion hole of said first secondary-side bobbin and a core inserted into said core insertion hole of said second secondary-side bobbin to secure a predetermined magnetic gap.

6. The high-voltage transformer according to claim 2, wherein a first secondary-side bobbin and a second secondary-side bobbin are provided in such a way that tips of said respective rolls face each other via an insulating flange-shaped barrier, a core insertion hole extending in direction in which said central axis extends is formed substantially coaxially inside the roll of said first secondary-side bobbin and the roll of said second secondary-side bobbin, and said flange-shaped barrier is provided with a spacer insertion hole into which an insulating spacer is inserted between a core inserted into said core insertion hole of said first secondary-side bobbin and a core inserted into said core insertion hole of said second secondary-side bobbin to secure a predetermined magnetic gap.

7. The high-voltage transformer according to claim 3, wherein a first secondary-side bobbin and a second secondary-side bobbin are provided in such a way that tips of said respective rolls face each other via an insulating flange-shaped barrier, a core insertion hole extending in direction in which said central axis extends is formed substantially coaxially inside the roll of said first secondary-side bobbin and the roll of said second secondary-side bobbin, and said flange-shaped barrier is provided with a spacer insertion hole into which an insulating spacer is inserted between a core inserted into said core insertion hole of said first secondary-side bobbin and a core inserted into said core insertion hole of said second secondary-side bobbin to secure a predetermined magnetic gap.

8. The high-voltage transformer according to claim 4, wherein a first secondary-side bobbin and a second secondary-side bobbin are provided in such a way that tips of said respective rolls face each other via an insulating flange-shaped barrier, a core insertion hole extending in direction in which said central axis extends is formed substantially coaxially inside the roll of said first secondary-side bobbin and the roll of said second secondary-side bobbin, and said flange-shaped barrier is provided with a spacer insertion hole into which an insulating spacer is inserted between a core inserted into said core insertion hole of said first secondary-side bobbin and a core inserted into said core insertion hole of said second secondary-side bobbin to secure a predetermined magnetic gap.

9. The high-voltage transformer according to claim 8, wherein the secondary-side terminal support in which the secondary-side terminal is implanted, is formed integral with said first secondary-side bobbin, said second secondary-side bobbin and said flange-shaped barrier.

10. The high-voltage transformer according to claim 9, wherein the first primary-side bobbin and the second primary-side bobbin each have a roll around which said primary winding is wound and are provided in such a way that ends of said respective rolls face each other via an insulating flange-shaped barrier, a core insertion hole extending in a direction in which the central axis of said roll extends is formed inside the roll of said first primary-side bobbin and the roll of said second primary-side bobbin substantially coaxially respectively, and said flange-shaped barrier is provided with a spacer insertion hole into which an insulating spacer to secure a predetermined magnetic gap is inserted between a core inserted into said core insertion hole of said first primary-side bobbin and a core inserted into said core insertion hole of said second primary-side bobbin.

11. The high-voltage transformer according to claim 10, wherein a primary-side terminal support in which the primary-side terminal is implanted is formed integral with said first primary-side bobbin, said second primary-side bobbin and said flange-shaped barrier.

12. The high-voltage transformer according to claim 11, further comprising two E-shaped cores.

* * * * *